US009901982B2

(12) United States Patent
Cook, III et al.

(10) Patent No.: US 9,901,982 B2
(45) **Date of Patent: *Feb. 27, 2018**

(54) INSULATION ENCLOSURE WITH VARYING THERMAL PROPERTIES

(71) Applicant: Halliburton Energy Services, Inc., Houston, TX (US)

(72) Inventors: Grant O. Cook, III, Spring, TX (US); Jeff G. Thomas, Magnolia, TX (US); Clayton A. Ownby, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 246 days.

This patent is subject to a terminal disclaimer.

(21) Appl. No.: 14/439,051

(22) PCT Filed: Jun. 25, 2014

(86) PCT No.: PCT/US2014/043984

§ 371 (c)(1),
(2) Date: Apr. 28, 2015

(87) PCT Pub. No.: WO2015/199665

PCT Pub. Date: Dec. 30, 2015

(65) Prior Publication Data

US 2016/0288202 A1 Oct. 6, 2016

(51) Int. Cl.
*B22D 27/04* (2006.01)
*B22F 3/00* (2006.01)
(Continued)

(52) U.S. Cl.
CPC ..... *B22D 27/045* (2013.01); *B22D 15/04* (2013.01); *B22D 19/02* (2013.01); *B22D 25/02* (2013.01);
(Continued)

(58) Field of Classification Search
CPC ..... B22D 27/045; B22D 30/00
(Continued)

(56) References Cited

U.S. PATENT DOCUMENTS 4,113,473 A 9/1978 Gauvry et al.
4,409,451 A * 10/1983 Taylor ..... B22D 27/045 164/507
(Continued)

FOREIGN PATENT DOCUMENTS

GB 2343194 A 5/2000
GB 2364529 A 1/2002
(Continued)

OTHER PUBLICATIONS

International Search Report and Written Opinion for PCT/US2014/043984 dated Mar. 25, 2015.

*Primary Examiner* — Scott Kastler
(74) *Attorney, Agent, or Firm* — McDermott Will & Emery LLP

(57) ABSTRACT

An example insulation enclosure for cooling a mold includes a support structure having a top end, a bottom end, and an interior, the bottom end defining an opening for receiving a mold within the interior of the support structure, and insulation material supported by the support structure and extending at least from the bottom end to the top end, wherein one or more thermal properties of at least one of the support structure and the insulation material varies longitudinally from the bottom end to the top end. In some cases, the one or more thermal properties are further varied about a circumference of the support structure.

17 Claims, 4 Drawing Sheets

(51) Int. Cl.

| | |
|---|---|
| ***B22D 15/04*** | (2006.01) |
| ***B22D 19/02*** | (2006.01) |
| ***B22D 25/02*** | (2006.01) |
| ***E21B 10/42*** | (2006.01) |
| ***E21B 10/54*** | (2006.01) |
| *B22F 5/00* | (2006.01) |
| *C22C 1/10* | (2006.01) |

(52) U.S. Cl.
CPC ..... *B22F 3/003* (2013.01); *E21B 10/42* (2013.01); *E21B 10/54* (2013.01); *B22F 2005/001* (2013.01); *B22F 2999/00* (2013.01); *C22C 2001/1073* (2013.01)

(58) Field of Classification Search
USPC ..... 164/507
See application file for complete search history.

(56) References Cited

U.S. PATENT DOCUMENTS

| | | | | |
|---|---|---|---|---|
| 6,035,924 | A | 3/2000 | Graham | |
| 6,220,117 | B1 | 4/2001 | Butcher | |
| 2005/0022959 | A1* | 2/2005 | Soderstrom ..... | B22D 27/045 164/122.1 |
| 2009/0301682 | A1 | 12/2009 | Proske et al. | |
| 2010/0278604 | A1 | 11/2010 | Glass et al. | |
| 2015/0375299 | A1* | 12/2015 | Ownby ..... | B22D 30/00 164/61 |
| 2016/0305191 | A1* | 10/2016 | Cook, III ..... | C21D 9/663 |

FOREIGN PATENT DOCUMENTS

| | | | |
|---|---|---|---|
| JP | 2014008775 | A | 1/2014 |
| WO | 2015199665 | A1 | 12/2015 |

* cited by examiner

INSULATION ENCLOSURE WITH VARYING THERMAL PROPERTIES

BACKGROUND

The present disclosure relates to oilfield tool manufacturing and, more particularly, to insulation enclosures that help control the thermal profile of drill bits during manufacture to prevent manufacturing defects.

Rotary drill bits are often used to drill oil and gas wells, geothermal wells, and water wells. One type of rotary drill bit is a fixed-cutter drill bit having a bit body comprising matrix and reinforcement materials, i.e., a "matrix drill bit" as referred to herein. Matrix drill bits usually include cutting elements or inserts positioned at selected locations on the exterior of the matrix bit body. Fluid flow passageways are formed within the matrix bit body to allow communication of drilling fluids from associated surface drilling equipment through a drill string or drill pipe attached to the matrix bit body. The drilling fluids lubricate the cutting elements on the matrix drill bit.

Matrix drill bits are typically manufactured by placing powder material into a mold and infiltrating the powder material with a binder material, such as a metallic alloy. The various features of the resulting matrix drill bit, such as blades, cutter pockets, and/or fluid-flow passageways, may be provided by shaping the mold cavity and/or by positioning temporary displacement material within interior portions of the mold cavity. A preformed bit blank (or steel shank) may be placed within the mold cavity to provide reinforcement for the matrix bit body and to allow attachment of the resulting matrix drill bit with a drill string. A quantity of matrix reinforcement material (typically in powder form) may then be placed within the mold cavity with a quantity of the binder material.

The mold is then placed within a furnace and the temperature of the mold is increased to a desired temperature to allow the binder (e.g., metallic alloy) to liquefy and infiltrate the matrix reinforcement material. The furnace typically maintains this desired temperature to the point that the infiltration process is deemed complete, such as when a specific location in the bit reaches a certain temperature. Once the designated process time or temperature has been reached, the mold containing the infiltrated matrix bit is removed from the furnace. As the mold is removed from the furnace, the mold begins to rapidly lose heat to its surrounding environment via heat transfer, such as radiation and/or convection in all directions, including both radially from a bit axis and axially parallel with the bit axis. Upon cooling, the infiltrated binder (e.g., metallic alloy) solidifies and incorporates the matrix reinforcement material to form a metal-matrix composite bit body and also binds the bit body to the bit blank to form the resulting matrix drill bit.

Typically, cooling begins at the periphery of the infiltrated matrix and continues inwardly, with the center of the bit body cooling at the slowest rate. Thus, even after the surfaces of the infiltrated matrix of the bit body have cooled, a pool of molten material may remain in the center of the bit body. As the molten material cools, there is a tendency for shrinkage that could result in voids forming within the bit body unless molten material is able to continuously backfill such voids. In some cases, for instance, one or more intermediate regions within the bit body may solidify prior to adjacent regions and thereby stop the flow of molten material to locations where shrinkage porosity is developing. In other cases, shrinkage porosity may result in poor metallurgical bonding at the interface between the bit blank and the molten materials, which can result in the formation of cracks within the bit body that can be difficult or impossible to inspect. When such bonding defects are present and/or detected, the drill bit is often scrapped during or following manufacturing or the lifespan of the drill bit may be dramatically reduced. If these defects are not detected and the drill bit is used in a job at a well site, the bit can fail and/or cause damage to the well including loss of rig time.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to oilfield tool manufacturing and, more particularly, to insulation enclosures that help control the thermal profile of drill bits during manufacture to prevent manufacturing defects.

The present disclosure describes various embodiments of an insulation enclosure configured to help control the thermal profile of a mold, and thereby enhance directional solidification of molten contents positioned within the mold. More specifically, the exemplary insulation enclosures described herein exhibit varying thermal properties along a longitudinal direction and/or a circumference of the insulation enclosure. In some embodiments, for instance, the thermal resistance or thermal conductivity of insulation material may vary in the longitudinal direction, thereby yielding an insulation enclosure with insulating properties that vary along the longitudinal direction, such as along a vertical direction with respect to the mold in its upright orientation during cooling. For example, some embodiments have higher insulating properties in the topmost region of the insulation enclosure and lower insulating properties in the bottommost region. In other embodiments, one or more heating elements, such as an active or passive heating element, which may include a heat exchanger, an induction heater, or other examples further described below, may be employed to maintain higher temperatures in the topmost region of the insulation enclosure and lower temperatures in the bottommost region. As a result, the rate of thermal energy loss through the insulation enclosure may be graded longitudinally, with most thermal energy being lost out of the bottommost region. Advantageously, the presently described embodiments may facilitate a more controlled cooling process for a mold and thereby optimize the directional solidification of any molten contents within the mold and also mitigate shrinkage porosity.

Figure 1:
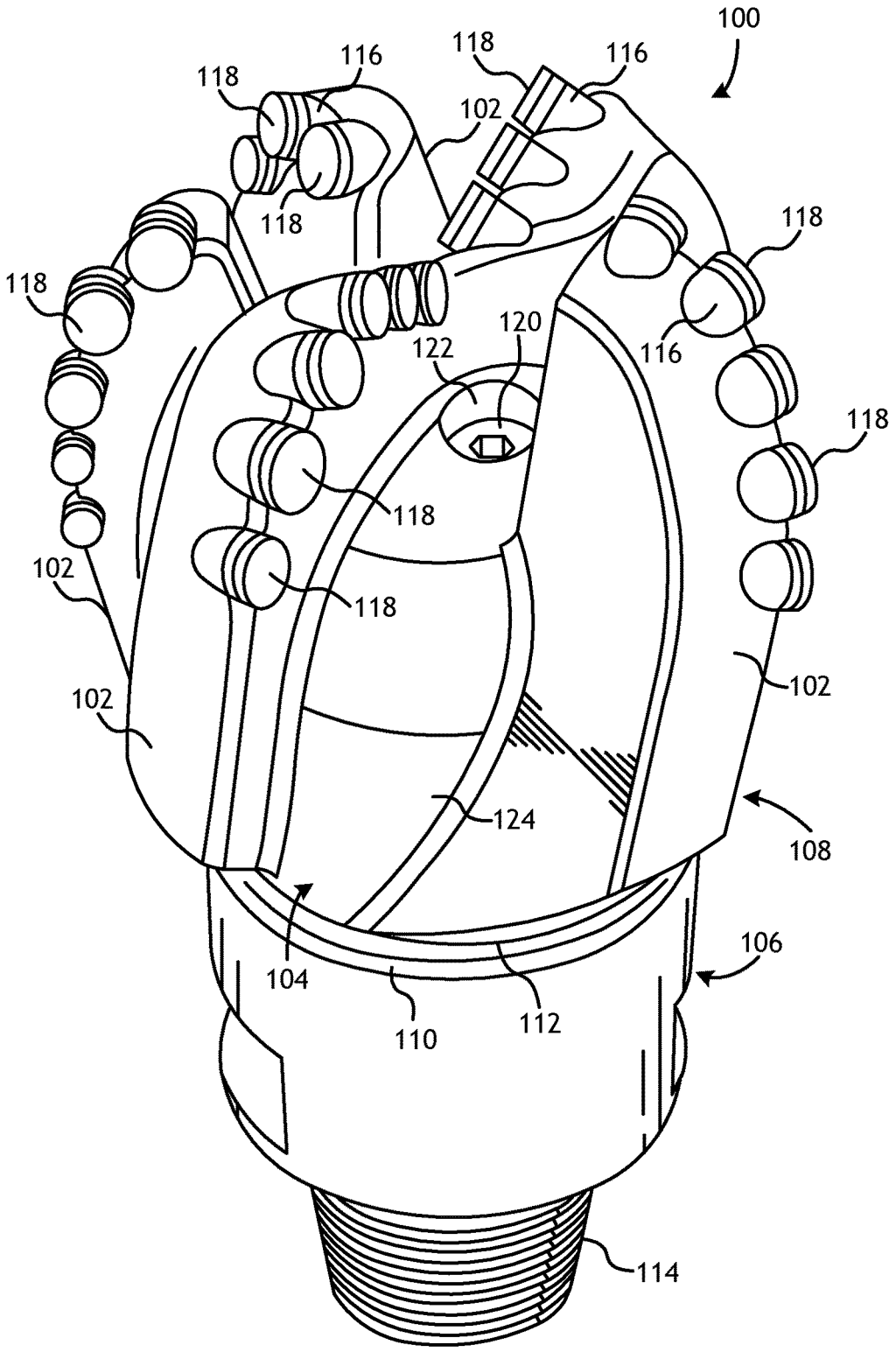
FIG. 1 illustrates an exemplary fixed-cutter drill bit that may be fabricated in accordance with the principles of the present disclosure.

FIG. 1 illustrates a perspective view of an example of a fixed-cutter drill bit 100 that may be fabricated in accordance with the principles of the present disclosure. As illustrated, the fixed-cutter drill bit 100 (hereafter "the drill bit 100") may include or otherwise define a plurality of cutter blades 102 arranged along the circumference of a bit head 104. The bit head 104 is connected to a shank 106 to form a bit body 108. The shank 106 may be connected to the bit head 104 by welding, such as using laser arc welding that results in the formation of a weld 110 around a weld groove 112. The shank 106 may further include or otherwise be connected to a threaded pin 114, such as an American Petroleum Institute (API) drill pipe thread.

In the depicted example, the drill bit 100 includes five cutter blades 102, in which multiple pockets or recesses 116 (also referred to as "sockets" and/or "receptacles") are formed. Cutting elements 118, otherwise known as inserts, may be fixedly installed within each recess 116. This can be done, for example, by brazing each cutting element 118 into a corresponding recess 116. As the drill bit 100 is rotated in use, the cutting elements 118 engage the rock and underlying earthen materials, to dig, scrape or grind away the material of the formation being penetrated.

During drilling operations, drilling fluid (commonly referred to as "mud") can be pumped downhole through a drill string (not shown) coupled to the drill bit 100 at the threaded pin 114. The drilling fluid circulates through and out of the drill bit 100 at one or more nozzles 120 positioned in nozzle openings 122 defined in the bit head 104. Formed between each adjacent pair of cutter blades 102 are junk slots 124, along which cuttings, downhole debris, formation fluids, drilling fluid, etc., may pass and circulate back to the well surface within an annulus formed between exterior portions of the drill string and the interior of the wellbore being drilled (not expressly shown).

Figure 2A:
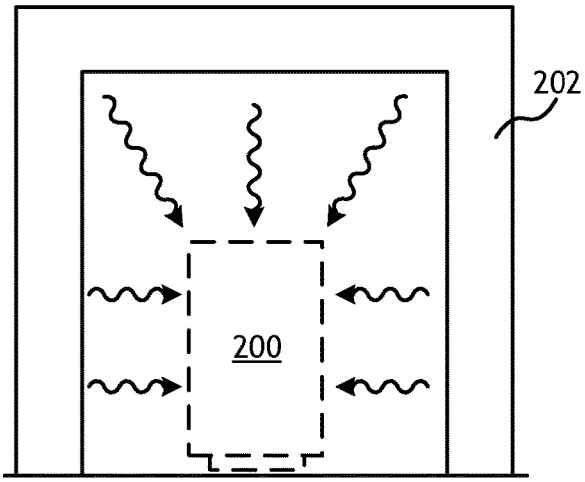
FIGS. 2A-2C illustrate progressive schematic diagrams of an exemplary method of fabricating a drill bit, in accordance with the principles of the present disclosure.
Figure 2B:
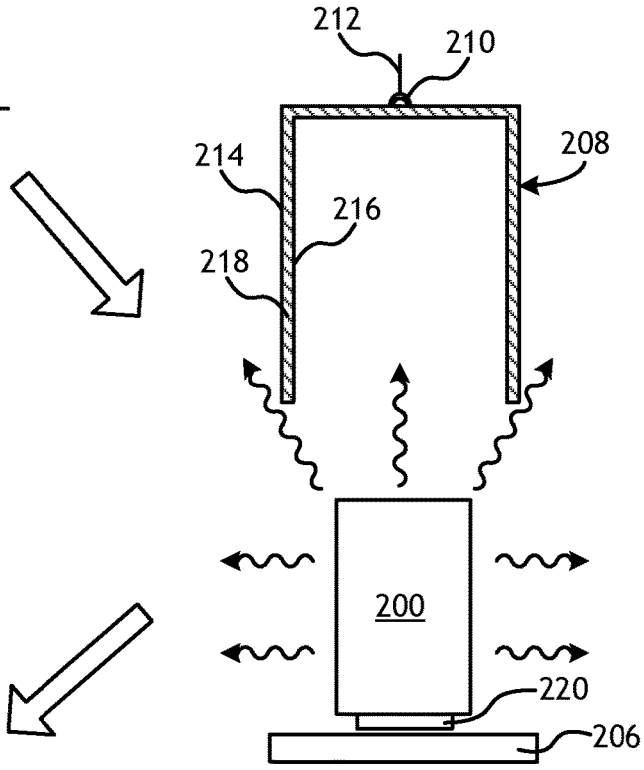
Figure 2C:
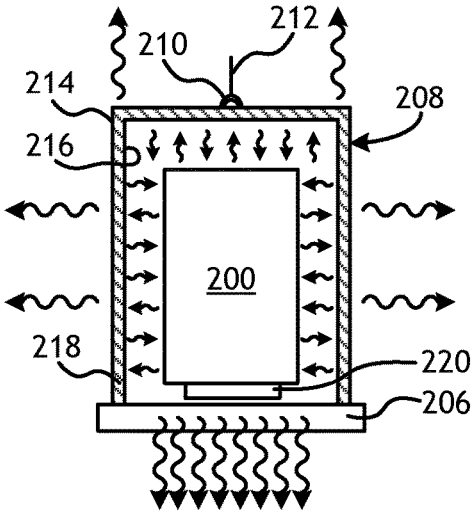

FIGS. 2A-2C are schematic diagrams that sequentially illustrate an example method of fabricating a drill bit, such as the drill bit 100 of FIG. 1, in accordance with the principles of the present disclosure. In FIG. 2A, a mold 200 is placed within a furnace 202. While not specifically depicted in FIGS. 2A-2C, the mold 200 may include and otherwise contain all the necessary materials and component parts required to produce a drill bit including, but not limited to, reinforcement materials, a binder material, displacement materials, a bit blank, etc.

For some applications, two or more different types of matrix reinforcement materials or powders may be positioned in the mold 200. Examples of such matrix reinforcement materials may include, but are not limited to, tungsten carbide, monotungsten carbide (WC), ditungsten carbide ($W_2C$), macrocrystalline tungsten carbide, other metal carbides, metal borides, metal oxides, metal nitrides, natural and synthetic diamond, and polycrystalline diamond (PCD). Examples of other metal carbides may include, but are not limited to, titanium carbide and tantalum carbide, and various mixtures of such materials may also be used. Various binder (infiltration) materials that may be used include, but are not limited to, metallic alloys of copper (Cu), nickel (Ni), manganese (Mn), lead (Pb), tin (Sn), cobalt (Co) and silver (Ag). Phosphorous (P) may sometimes also be added in small quantities to reduce the melting temperature range of infiltration materials positioned in the mold 200. Various mixtures of such metallic alloys may also be used as the binder material.

The temperature of the mold 200 and its contents are elevated within the furnace 202 until the binder liquefies and is able to infiltrate the matrix material. Once a specified location in the mold 200 reaches a certain temperature in the furnace 202, or the mold 200 is otherwise maintained at a particular temperature within the furnace 202 for a predetermined amount of time, the mold 200 is then removed from the furnace 202. Upon being removed from the furnace 202, the mold 200 immediately begins to lose heat by radiating thermal energy to its surroundings while heat is also convected away by cold air from outside the furnace 202. In some cases, as depicted in FIG. 2B, the mold 200 may be transported to and set down upon a heat sink 206. The radiative and convective heat losses from the mold 200 to the environment continue until an insulation enclosure 208 is lowered around the mold 200.

The insulation enclosure 208 may be a rigid shell or structure used to insulate the mold 200 and thereby slow the cooling process. In some cases, the insulation enclosure 208 may include a hook 210 attached to a top surface thereof. The hook 210 may provide an attachment location, such as for a lifting member, whereby the insulation enclosure 208 may be grasped and/or otherwise attached to for transport. For instance, a chain or wire 212 may be coupled to the hook 210 to lift and move the insulation enclosure 208, as illustrated. In other cases, a mandrel or other type of manipulator (not shown) may grasp onto the hook 210 to move the insulation enclosure 208 to a desired location.

In some embodiments, the insulation enclosure 208 may include an outer frame 214, an inner frame 216, and insulation material 218 positioned between the outer and inner frames 214, 216. In some embodiments, both the outer frame 214 and the inner frame 216 may be made of rolled steel and shaped (i.e., bent, welded, etc.) into the general shape, design, and/or configuration of the insulation enclosure 208. In other embodiments, the inner frame 216 may be a metal wire mesh that holds the insulation material 218 between the outer frame 214 and the inner frame 216. The insulation material 218 may be selected from a variety of insulative materials, such as those discussed below. In at least one embodiment, the insulation material 218 may be a ceramic fiber blanket, such as INSWOOL® or the like.

As depicted in FIG. 2C, the insulation enclosure 208 may enclose the mold 200 such that thermal energy radiating from the mold 200 is dramatically reduced from the top and sides of the mold 200 and is instead directed substantially downward and otherwise toward/into the heat sink 206 or back towards the mold 200. In the illustrated embodiment, the heat sink 206 is a cooling plate designed to circulate a fluid (e.g., water) at a reduced temperature relative to the mold 200 (i.e., at or near ambient) to draw thermal energy from the mold 200 and into the circulating fluid, and thereby reduce the temperature of the mold 200. In other embodiments, however, the heat sink 206 may be any type of cooling device or heat exchanger configured to encourage heat transfer from the bottom 220 of the mold 200 to the heat sink 206. In yet other embodiments, the heat sink 206 may be any stable or rigid surface that may support the mold 200, and preferably having a high thermal capacity, such as a concrete slab or flooring.

Accordingly, once the insulation enclosure 208 is arranged about the mold 200 and the heat sink 206 is operational, the majority of the thermal energy is transferred away from the mold 200 through the bottom 220 of the mold 200 and into the heat sink 206. This controlled cooling of the mold 200 and its contents (i.e., the matrix drill bit) allows a user to regulate or control the thermal profile of the mold 200 to a certain extent and may result in directional solidification of the molten contents of the drill bit positioned within the mold 200, where axial solidification of the drill bit dominates its radial solidification. Within the mold 200, the face of the drill bit (i.e., the end of the drill bit that includes the cutters) may be positioned at the bottom 220 of the mold 200 and otherwise adjacent the thermal heat sink 206 while the shank 106 (FIG. 1) may be positioned adjacent the top of the mold 200. As a result, the drill bit may be cooled axially upward, from the cutters 118 (FIG. 1) toward the shank 106 (FIG. 1). Such directional solidification (from the bottom up) may prove advantageous in reducing the occurrence of voids due to shrinkage porosity, cracks at the interface between the bit blank and the molten materials, and nozzle cracks.

While FIG. 1 depicts a fixed-cutter drill bit 100 and FIGS. 2A-2C discuss the production of a generalized drill bit within the mold 200, the principles of the present disclosure are equally applicable to any type of oilfield drill bit or cutting tool including, but not limited to, fixed-angle drill bits, roller-cone drill bits, coring drill bits, bi-center drill bits, impregnated drill bits, reamers, stabilizers, hole openers, cutters, cutting elements, and the like. Moreover, it will be appreciated that the principles of the present disclosure may further apply to fabricating other types of tools and/or components formed, at least in part, through the use of molds. For example, the teachings of the present disclosure may also be applicable, but not limited to, non-retrievable drilling components, aluminum drill bit bodies associated with casing drilling of wellbores, drill-string stabilizers, cones for roller-cone drill bits, models for forging dies used to fabricate support arms for roller-cone drill bits, arms for fixed reamers, arms for expandable reamers, internal components associated with expandable reamers, sleeves attached to an uphole end of a rotary drill bit, rotary steering tools, logging-while-drilling tools, measurement-while-drilling tools, side-wall coring tools, fishing spears, wash-over tools, rotors, stators and/or housings for downhole drilling motors, blades and housings for downhole turbines, and other downhole tools having complex configurations and/or asymmetric geometries associated with forming a wellbore.

According to the present disclosure, the thermal profile of the mold 200 may be controlled by altering the configuration and/or design of the insulation enclosure 208, providing an insulation enclosure that exhibits varying thermal properties along a longitudinal direction (e.g., from the bottom to the top of the insulation enclosure). In some cases, the thermal resistance or thermal conductivity of the insulation material 218 may vary in the longitudinal direction, thereby yielding an insulation enclosure with insulating properties that increase with height. In one example, such an enclosure may have its highest insulating properties in the topmost region and lowest insulating properties in the bottommost region. In other cases, the insulation enclosure may employ one or more heating elements (e.g., a heat exchanger, an induction heater, etc., or other examples further described below) configured to maintain higher temperatures in the topmost region of the insulation enclosure and lower temperatures in the bottommost region. As a result, the rate of thermal energy loss through the insulation enclosure may be graded in the longitudinal direction, such that during the cooling of the mold, the heat flux out of the insulation enclosure increases toward the bottom, and may be at a maximum value at the bottommost region. The embodiments disclosed herein may facilitate a more controlled cooling process for the mold 200 and optimize the directional solidification of the molten contents within the mold 200 (e.g., a drill bit). Through directional solidification, any potential defects (e.g., voids) may be formed at higher and/or more outward positions of the mold 200 where they can be machined off later during finishing operations.

Figure 3:
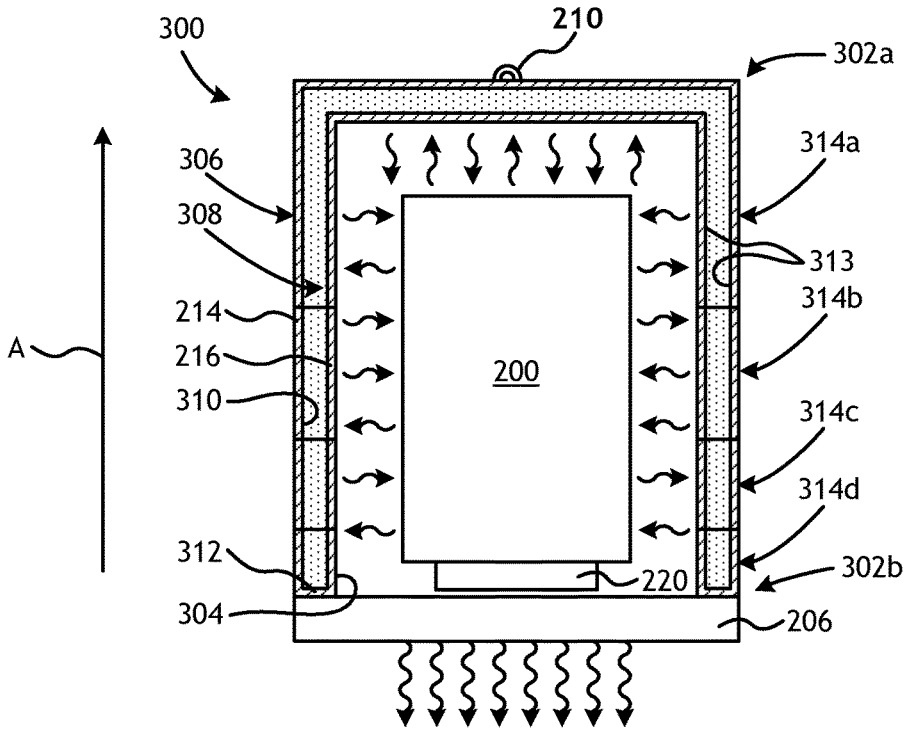
FIG. 3 illustrates a cross-sectional side view of an exemplary insulation enclosure, according to one or more embodiments.

FIG. 3 is a cross-sectional side view of an exemplary insulation enclosure 300 set upon the thermal heat sink 206, according to one or more embodiments. The insulation enclosure 300 may be similar in some respects to the insulation enclosure 208 of FIGS. 2B and 2C and therefore may be best understood with reference thereto, where like numerals indicate like elements or components not described again. The insulation enclosure 300 may include a support structure 306 and insulation material 308 supported by the support structure 306. The insulation enclosure 300 (e.g., the support structure 306) may be an open-ended cylindrical structure having a top end 302*a* and bottom end 302*b*. The bottom end 302*b* may be open or otherwise define an opening 304 configured to receive the mold 200 so that the mold 200 can be arranged within the interior of the insulation enclosure 300 (e.g., the support structure 306) as the insulation enclosure 300 is lowered around the mold 200. The top end 302*a* may be closed and provide the hook 210 on its outer surface, as described above.

The insulation material 308 may generally extend between the top and bottom ends 302*a,b* of the support structure 306. The insulation material 308 may be supported by the support structure 306 via various configurations of the insulation enclosure 300. For instance, as depicted in the illustrated embodiment, the support structure 306 may include the outer frame 214 and the inner frame 216, as generally described above, which may be collectively referred to herein as the support structure 306. The outer and inner frames 214, 216 may cooperatively define a cavity 310, and the cavity 310 may be configured to receive and otherwise house the insulation material 308 therein. In some embodiments, as illustrated, the support structure 306 may further include a footing 312 at the bottom end 302*b* of the insulation enclosure 300 that extends between the outer and inner frames 214, 216. The footing 312 may serve as a support for the insulation material 308, and may prove especially useful when the insulation material 308 includes stackable and/or individual component insulative materials that may be stacked atop one another within the cavity 310.

In other embodiments, however, the outer frame 214 may be omitted from the insulation enclosure 300 and the insulation material 308 may alternatively be coupled to the inner frame 216 and/or otherwise supported by the footing 312. In yet other embodiments, the inner frame 216 may be omitted from the insulation enclosure 300 and the insulation material 308 may alternatively be coupled to the outer frame 216 and/or otherwise supported by the footing 312, without departing from the scope of the disclosure.

The support structure 306, including one or both of the outer and inner frames 214, 216, may be made of any rigid material including, but not limited to, metals, ceramics (e.g., a molded ceramic substrate), composite materials, combinations thereof, and the like. In at least one embodiment, the support structure 306, including one or both of the outer and inner frames 214, 216, may be a metal mesh. The support structure 306 may exhibit any suitable horizontal cross-sectional shape that will accommodate the general shape of the mold 200 including, but not limited to, circular, ovular, polygonal, polygonal with rounded corners, or any hybrid thereof. In some embodiments, the support structure 306 may exhibit different horizontal cross-sectional shapes and/or sizes at different vertical or longitudinal locations.

The insulation material 308 may be similar to the insulation material 218 of FIGS. 2B and 2C. The insulation material 308 may include, but is not limited to, ceramics (e.g., oxides, carbides, borides, nitrides, and silicides that may be crystalline, non-crystalline, or semi-crystalline), polymers, insulating metal composites, carbons, nanocomposites, foams, fluids (e.g., air), any composite thereof, or any combination thereof. The insulation material 308 may further include, but is not limited to, materials in the form of beads, particulates, flakes, fibers, wools, woven fabrics, bulked fabrics, sheets, bricks, stones, blocks, cast shapes, molded shapes, foams, sprayed insulation, and the like, any hybrid thereof, or any combination thereof. Accordingly, examples of suitable materials that may be used as the insulation material 308 may include, but are not limited to, ceramics, ceramic fibers, ceramic fabrics, ceramic wools, ceramic beads, ceramic blocks, moldable ceramics, woven ceramics, cast ceramics, fire bricks, carbon fibers, graphite blocks, shaped graphite blocks, polymer beads, polymer fibers, polymer fabrics, nanocomposites, fluids in a jacket, metal fabrics, metal foams, metal wools, metal castings, and the like, any composite thereof, or any combination thereof.

Suitable materials that may be used as the insulation material 308 may be capable of maintaining the mold 200 at temperatures ranging from a lower limit of about −200° C. (−325° F.), −100° C. (−150° F.), 0° C. (32° F.), 150° C. (300° F.), 175° C. (350° F.), 260° C. (500° F.), 400° C. (750° F.), 480° C. (900° F.), or 535° C. (1000° F.) to an upper limit of about 870° C. (1600° F.), 815° C. (1500° F.), 705° C. (1300° F.), 535° C. (1000° F.), 260° C. (500° F.), 0° C. (32° F.), or −100° C. (−150° F.), wherein the temperature may range from any lower limit to any upper limit and encompass any subset therebetween. Moreover, suitable materials that may be used as the insulation material 308 may be able to withstand temperatures ranging from a lower limit of about −200° C. (−325° F.), −100° C. (−150° F.), 0° C. (32° F.), 150° C. (300° F.), 260° C. (500° F.), 400° C. (750° F.), or 535° C. (1000° F.) to an upper limit of about 870° C. (1600° F.), 815° C. (1500° F.), 705° C. (1300° F.), 535° C. (1000° F.), 0° C. (32° F.), or −100° C. (−150° F.), wherein the temperature may range from any lower limit to any upper limit and encompass any subset therebetween. Those skilled in the art will readily appreciate that the insulation material 308 may be appropriately chosen for the particular application and temperature to be maintained within the insulation enclosure 300.

In some embodiments, in addition to the materials mentioned above, or independent thereof, a reflective coating or material may be positioned on an inner surface of the support structure 306. More particularly, the reflective coating or material may be applied to, adhered to and/or sprayed onto the inner surface of one or both of the outer and inner frames 214, 216 in order to reflect an amount of thermal energy emitted from the mold 200 back toward the mold 200. Furthermore, an insulative coating 313, such as a thermal barrier coating, may be applied to one or both of the outer and inner frames 214, 216. Such an insulative coating 313 could provide a thermal barrier between adjacent materials, such as the inner frame 216 and insulation material 308 or the insulation material 308 and the outer frame 214. In other embodiments, or in addition thereto, the inner surface of one or both of the outer and inner frames 214, 216 may be polished so as to increase its emissivity.

The insulation enclosure 300 may be configured to control the thermal profile of the mold 200 during cooling by varying one or more thermal properties along a longitudinal direction A of the insulation enclosure 300. More particularly, one or more thermal properties of the insulation enclosure 300 may be altered from the bottom end 302*b* of the insulation enclosure 300 to the top end 302*a*. Exemplary thermal properties that may be varied in the longitudinal direction A include, but are not limited to, thermal resistance (i.e., R-value), thermal conductivity (k), specific heat capacity ($C_P$), density (i.e., weight per unit volume of the insulation material 308), thermal diffusivity, temperature, surface characteristics (e.g., roughness, coating, paint), emissivity, absorptivity, and any combination thereof.

By varying the thermal properties in the longitudinal direction A, higher insulating properties at or near the top end 302*a* of the insulation enclosure 300 and lower insulating properties at or near the bottom end 302*b* may result. As a result, the rate of thermal energy loss through the insulation enclosure 300 may be graded in the longitudinal direction A, with more thermal energy being lost at or near the bottom end 302*b* as opposed to the top end 302*a*. Consequently, the thermal profile of the mold 200 may thereby be controlled such that directional solidification of the molten contents within the mold 200 is substantially achieved from the bottom 220 of the mold 200 axially upward in the longitudinal direction A, rather than radially through the sides of the mold 200.

In some embodiments, the sidewalls of the insulation enclosure 300 may be divided into a plurality of insulation zones 314 (shown as insulation zones 314*a*, 314*b*, 314*c*, and 314*d*). While four insulation zones 314*a-d* are depicted, those skilled in the art will readily appreciate that more or less than four insulation zones 314*a-d* may be employed in the insulation enclosure 300, without departing from the scope of the disclosure. Indeed, the number of discrete insulation zones 314*a-d* may vary depending upon the specifications of the tool or device being fabricated within mold 200 (e.g., the drill bit 100 of FIG. 1).

Varying at least one of the thermal resistance, thermal conductivity, specific heat capacity, density, thermal diffusivity, temperature, emissivity, and absorptivity along the longitudinal direction A of the insulation enclosure 300 may be accomplished passively by configuring the insulation zones 314*a-d* such that more thermal energy losses are permitted through the insulation zones 314*a-d* arranged at or near the bottom end 302*b* of the insulation enclosure 300 as compared to thermal energy losses permitted through the insulation zones 314*a-d* arranged at or near the top end 302*a*.

In at least one embodiment, for example, the support structure 306 and/or the insulation material 308 may be varied such that the thermal resistance (R-value) of the insulation zones 314*a-d* arranged at or near the bottom end 302*b* of the insulation enclosure 300 is less than the thermal resistance (R-value) of the insulation zones 314*a-d* arranged at or near the top end 302*a*. In such an embodiment, the first insulation zone 314*a* may exhibit a first R-value "$R_1$," the second insulation zone 314*b* may exhibit a second R-value "$R_2$," the third insulation zone 314*c* may exhibit a third R-value "$R_3$," and the fourth insulation zone 314*d* may exhibit a fourth R-value "$R_4$," where $R_1>R_2>R_3>R_4$. Accordingly, the R-value of the insulation enclosure 300 may increase in the longitudinal direction A from the bottom end 302*b* of the insulation enclosure 300 toward the top end 302*a* such that more thermal energy is retained at or near the top of the mold 200 while thermal energy is drawn out of the bottom 220 via the thermal heat sink 206.

As will be appreciated by those skilled in the art, the graded R-values $R_1$-$R_4$ for each insulation zone 314*a-d* may be achieved in various ways, such as by using different materials for one or both of the support structure 306 and the insulation material 308 at each insulation zone 314*a-d*. The graded R-values for each insulation zone 314*a-d* may also be achieved by varying the thickness and/or density of one or both of the support structure 306 and the insulation material 308 at each insulation zone 314*a-d*. For instance, in one or more embodiments, the insulation material 308 of the insulation zones 314*a-d* arranged at or near the top end 302*a* of the insulation enclosure 300 may include multiple layers or wraps of insulation material 308, such as multiple layers or wraps of a ceramic fiber blanket (e.g., INSWOOL®). The increased thickness and/or density of the insulation material 308 of the insulation zones 314*a-d* arranged at or near the top end 302*a* may correspondingly increase the R-value.

In other embodiments, the support structure 306 and/or the insulation material 308 may be varied such that the thermal conductivity (k) of the insulation zones 314*a-d* arranged at or near the bottom end 302*b* of the insulation enclosure 300 is greater than the thermal conductivity (k) of the insulation zones 314*a-d* arranged at or near the top end 302*a*. In such an embodiment, the first insulation zone 314*a* may exhibit a first thermal conductivity "$k_1$," the second insulation zone 314*b* may exhibit a second thermal conductivity "$k_2$," the third insulation zone 314*c* may exhibit a third thermal conductivity "$k_3$," and the fourth insulation zone 314*d* may exhibit a fourth thermal conductivity "$k_4$," where $k_1<k_2<k_3<k_4$. Accordingly, the thermal conductivity of the insulation enclosure 300 may decrease in the longitudinal direction A from the bottom end 302*b* of the insulation enclosure 300 toward the top end 302*a* such that more thermal energy is retained at or near the top of the mold 200 while thermal energy is drawn out of the bottom 220 via the thermal heat sink 206.

Similar to the graded R-values, those skilled in the art will readily appreciate that the graded thermal conductivities $k_1$-$k_4$ for each insulation zone 314*a-d* may be achieved in various ways, such as by using more thermally conductive materials for one or both of the support structure 306 and the insulation material 308 at the insulation zones 314 at or near the bottom end 302*b* of the insulation enclosure 300. In at least one embodiment, for instance, the support structure 306 at the insulation zones 314 at or near the bottom end 302*b* of the insulation enclosure 300 may be at least partially made of a steel cage or metal mesh, which exhibits a high thermal conductivity. The graded thermal conductivities for each insulation zone 314*a-d* may also be achieved by varying the thickness and/or density of one or both of the support structure 306 and the insulation material 308 at each insulation zone 314*a-d*. Accordingly, this may yield an insulation enclosure 300 with highest insulating properties in the insulation zones 314*a-d* near the top end 302*a* of the insulation enclosure 300 and lowest insulating properties in the insulation zones 314*a-d* near the bottom end 302*b*.

Figure 4:
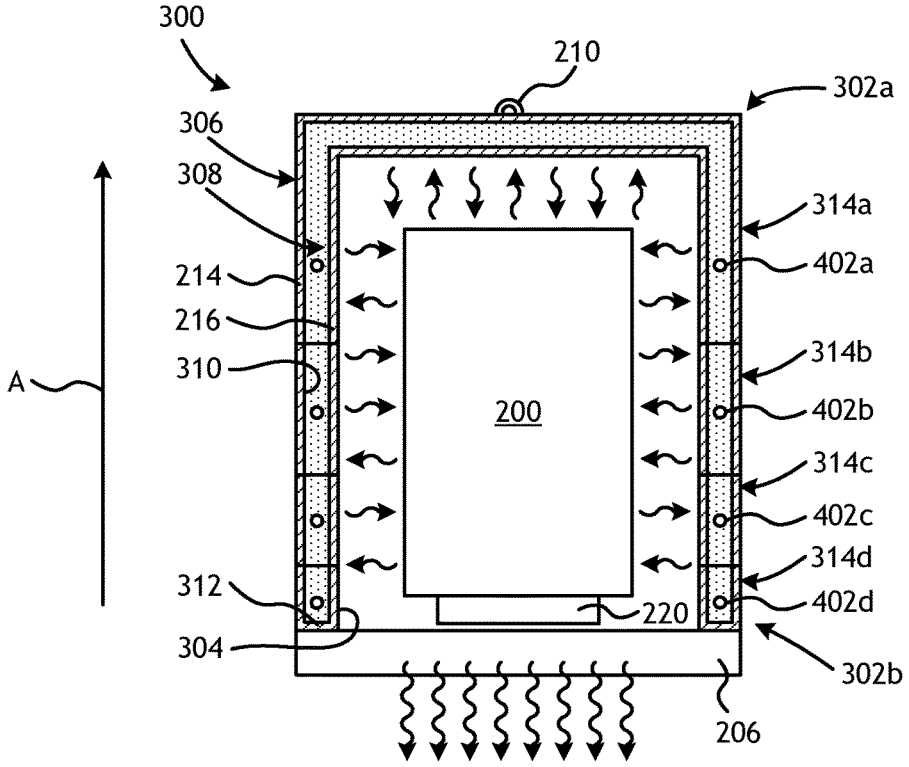
FIG. 4 illustrates a cross-sectional side view of another embodiment of the exemplary insulation enclosure of FIG. 3, according to one or more embodiments.

FIG. 4 illustrates a cross-sectional side view of another embodiment of the exemplary insulation enclosure 300, according to one or more embodiments. Similar to the embodiment of FIG. 3, the insulation enclosure 300 of FIG. 4 may be configured to control the thermal profile of the mold 200 during cooling by varying one or more thermal properties along the longitudinal direction A of the insulation enclosure 300. As a result, the rate of thermal energy loss through the insulation enclosure 300 may be graded such that most thermal energy is lost at or near the bottom end 302*b* of the insulation enclosure 300 as opposed to the top end 302*a*.

In the illustrated embodiment, the insulation enclosure 300 may include one or more heating elements 402 (shown as heating elements 402*a*, 402*b*, 402*c*, and 402*d*) arranged in thermal communication with the support structure 306 and, therefore, with the mold 200. As illustrated, the first heating element 402*a* is arranged in the first insulation zone 314*a*, the second heating element 402*b* is arranged in the second insulation zone 314*b*, the third heating element 402*c* is arranged in the third insulation zone 314*c*, and the fourth heating element 402*d* is arranged in the fourth insulation zone 314*d*. Each heating element 402*a-d* may be configured to actively vary the temperature of the mold 200 along the longitudinal direction A such that higher temperatures are maintained at or near the top end 302*a* of the insulation enclosure 300 as compared to lower temperatures being maintained at or near the bottom end 302*b*. As a result, more thermal energy losses are permitted through the insulation zones 314*a-d* arranged at or near the bottom end 302*b* of the insulation enclosure 300 as compared to thermal energy losses permitted through the insulation zones 314*a-d* arranged at or near the top end 302*a*.

Each heating element 402*a-d* may be any device or mechanism configured to impart thermal energy to the mold 200 and, more particularly, through the sidewalls of the support structure 306. For example, each heating element 402*a-d* may be, but is not limited to, a heating element, a heat exchanger, a radiant heater, an electric heater, an infrared heater, an induction heater, a heating band, heated coils, a heated fluid (flowing or static), an exothermic chemical reaction (e.g., combustion or exhaust gases), or any combination thereof. Suitable configurations for a heating element may include, but is not limited to, coils, plates, strips, finned strips, and the like, or any combination thereof.

While only four heating elements 402*a-d* are depicted in FIG. 4, it will be appreciated that any number of heating elements 402*a-d* may be employed in the insulation enclosure 300, without departing from the scope of the disclosure. Indeed, multiple heating elements 402*a-d* may be required in one or more of the insulation zones 314*a-d* at or near the top end 302*a* of the insulation enclosure 300 to maintain elevated temperatures.

The heating elements 402*a-d* may be in thermal communication with the mold 200 via a variety of configurations of the insulation enclosure 300. In the illustrated embodiment, for instance, the heating elements 402*a-d* are depicted as being embedded within the insulation material 308 in the sidewalls of the support structure 306. In other embodiments, however, the heating elements 402*a-d* may interpose the support structure 306 and the mold 200, such as being attached to the inner walls/surfaces of the support structure 300. The heating elements 402*a-d* may be useful in helping facilitate the directional solidification of the molten contents of the mold 200 as they provide increased thermal energy to the top of the mold 200 in the longitudinal direction A, while the thermal heat sink 206 draws thermal energy out the bottom 220 of the mold 200.

In the illustrated embodiment, the heating elements 402*a-d* are heating coils embedded within the insulation material 308 (e.g., a ceramic insulating material) in corresponding insulation zones 314*a-d*. In operation, each heating element 402*a-d* may be independently controlled and/or operated such that the thermal input to the mold 200 at each insulation zone 314*a-d* varies in the longitudinal direction A. Accordingly, the first insulation zone 314*a* may exhibit a first temperature "$T_1$," the second insulation zone 314*b* may exhibit a second temperature "$T_2$," the third insulation zone 314*c* may exhibit a third temperature "$T_3$," and the fourth insulation zone 314*d* may exhibit a fourth temperature "$T_4$," where $T_1>T_2>T_3>T_4$. Accordingly, the temperature within the insulation enclosure 300 may increase in the longitudinal direction A from the bottom end 302*b* of the insulation enclosure 300 toward the top end 302*a* such that more thermal energy is retained at or near the top of the mold 200 while thermal energy is drawn out of the bottom 220 via the thermal heat sink 206.

In other embodiments, several heating elements 402*a-d* (more than the four illustrated) may be arranged in a uniform array along the longitudinal direction A. In such embodiments, each heating element 402*a-d* may be independently controlled and/or operated to vary the thermal input at varying longitudinal locations across the height of the insulation enclosure 300. In yet other embodiments, the heating elements 402*a-d* may form part of a single heating coil wrapped multiple times about/within the support structure 306 and the single heating coil may be controlled from a single point source. In such embodiments, the temperature within the insulation enclosure 300 may be varied in the longitudinal direction A by varying the density of the revolutions of the heating coil about/within the support structure 306. For instance, the revolutions of the heating coil may be more dense at or near the top end 302*a* of the insulation enclosure 300 as opposed to the bottom end 302*b*, which may result in increased thermal input at the top end 302*a*.

In yet other embodiments, the temperature of the mold 200 may be actively varied along the longitudinal direction A by resistively heating the support structure 306 and, more particularly, the outer and/or inner frames 214 216. In such embodiments, the outer and/or inner frames 214, 216 may be a metallic cage or metal mesh and may be communicably coupled to one or more resistive heat sources (not shown). In operation, electric current passing through the outer and/or inner frames 214, 216 may encounter resistance, thereby resulting in heating of the outer and/or inner frames 214, 216. Through such resistive heating, higher temperatures may be maintained adjacent the mold 200 at or near the top end 302*a* of the insulation enclosure 300 as compared to lower temperatures maintained at or near the bottom end 302*b*. Consequently, the thermal profile of the mold 200 may thereby be controlled such that directional solidification of the molten contents within the mold 200 is substantially achieved from the bottom 220 of the mold 200 axially upward in the longitudinal direction A, rather than radially through the sides of the mold 200.

Figure 5:
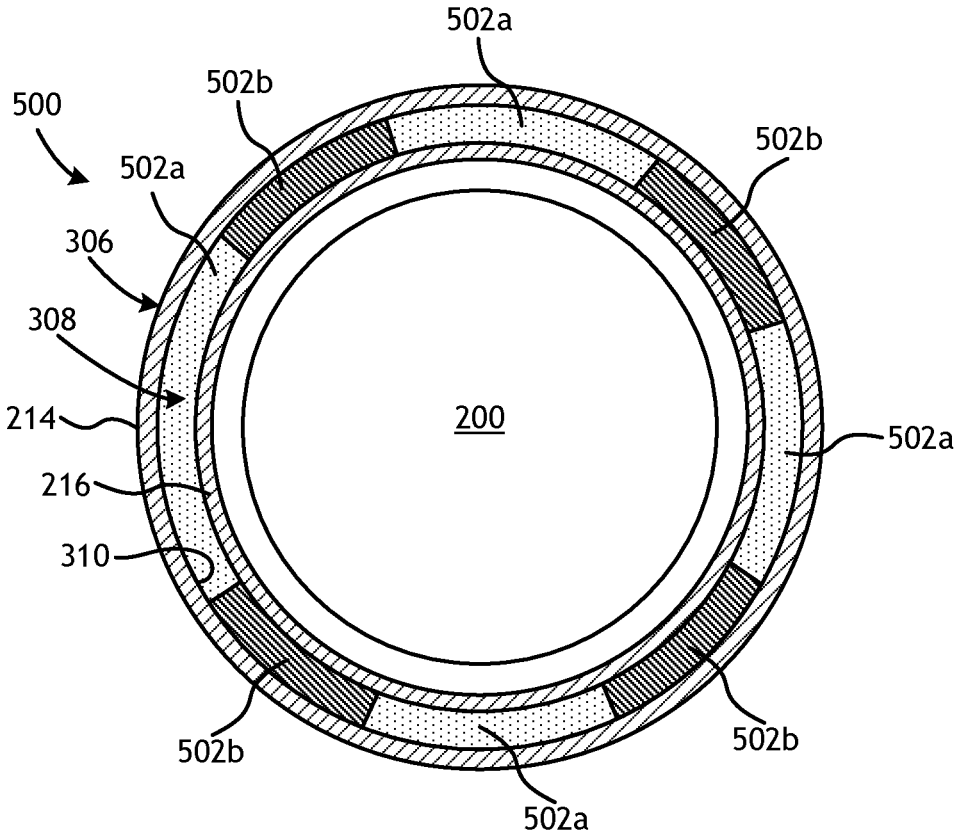
FIG. 5 illustrates a cross-sectional top view of another exemplary insulation enclosure, according to one or more embodiments.

FIG. 5 illustrates a cross-sectional top view of another exemplary insulation enclosure 500, according to one or more embodiments. The insulation enclosure 500 may be substantially similar to the insulation enclosures 300 of FIGS. 3 and 4 and therefore may be best understood with reference thereto, where like numerals will indicate like elements or components that will not be described again. The mold 200 is depicted in FIG. 5 as exhibiting a substantially circular cross-section. Those skilled in the art will readily appreciate, however, that the mold 200 may alternatively exhibit other cross-sectional shapes including, but not limited to, ovular, polygonal, polygonal with rounded corners, or any hybrid thereof.

As illustrated, the insulation enclosure 500 may include the support structure 306, including the outer and inner frames 214, 216, and the insulation material 308 positioned within the cavity 310 and otherwise supported by the support structure 306. Unlike the insulation enclosures 300 of FIGS. 3 and 4, however, the thermal properties of the insulation enclosure 500 may vary about a circumference of the insulation enclosure 500 (e.g., the support structure 306). Varying the thermal properties of the insulation enclosure 500 about its circumference may be configured to affect different geometries or structures in the tool or device being formed within the mold 200.

For instance, it may prove useful to vary thermal properties of the insulation enclosure 500 that may be placed radially or angularly adjacent portions of the mold 200 where cutter blades 102 (FIG. 1) of a drill bit 100 (FIG. 1) are being formed, as opposed to portions of the mold 200 containing junk slots 124 (FIG. 1). More particularly, it may prove advantageous to cool portions of the mold 200 where the cutter blades 102 are being formed slower than portions of the mold 200 containing the junk slots 124 so that any potential defects (e.g., voids) in the cutter blades 102 may be more effectively pushed or otherwise urged toward the top regions of the mold 200 where they can be machined off later during finishing operations.

In the illustrated embodiment, one or more arcuate portions of a first insulation material 502*a* and one or more arcuate portions of a second insulation material 502*b* may be arranged within the cavity 310. The first and second insulation materials 502*a,b* may be made of any of the materials listed above with respect to the insulation material 308. The first insulation material 502*a* may exhibit one or more first thermal properties and the second insulation material 502*b* may exhibit one or more second thermal properties. In some embodiments, for instance, the first insulation material 502*a* may exhibit an R-value "$R_1$" and the second insulation material 502*b* may exhibit an R-value "$R_2$," where $R_1>R_2$. In other embodiments, the first insulation material 502*a* may exhibit a thermal conductivity "$k_1$." and the second insulation material 502*b* may exhibit a thermal conductivity "$k_2$," where $k_1<k_2$. Accordingly, it may prove advantageous to radially and/or angularly align the arcuate portions of the first insulation material 502*a* with portions of the mold 200 that are preferred to cool more slowly than angularly adjacent portions where the arcuate portions of the second insulation material 502*b* are angularly aligned with.

It will be appreciated that the thermal properties of the insulation enclosure 500 may also be varied about its circumference by varying the thermal conductivity of the support structure 306 over corresponding arcuate portions or segments, without departing from the scope of the disclosure. Moreover, it will further be appreciated that the embodiments disclosed in all of FIGS. 3-5 may be combined in any combination, in keeping within the scope of the disclosure. For example, the thermal properties of the insulation enclosure 500 may be varied about its circumference and in the longitudinal direction A simultaneously. Such an example design might include circumferential insulation material 502*a,b* in insulation zone 314*d* with insulation material 308 in insulation zones 314*a-c*. In such an embodiment, the insulation material 308 might be the same as the insulation material 502*a* and the geometry of insulation material 502*b* might correspond to the junk slots 124 of a drill bit (e.g., the drill bit 100 of FIG. 1). Many other such configurations are possible without departing from the scope of the disclosure.

Embodiments disclosed herein include:

A. An insulation enclosure that includes a support structure having a top end, a bottom end, and an interior, the bottom end defining an opening, and insulation material supported by the support structure and extending at least from the bottom end to the top end, wherein one or more thermal properties of at least one of the support structure and the insulation material varies longitudinally from the bottom end to the top end.

B. A method that includes removing a mold from a furnace, the mold having a top and a bottom, placing the mold on a thermal heat sink with the bottom adjacent the thermal heat sink, lowering an insulation enclosure around the mold, the insulation enclosure including a support structure having a top end, a bottom end, and an interior for receiving the mold via an opening defined in the bottom end, the insulation enclosure further including insulation material supported by the support structure and extending at least from the bottom end to the top end, varying one or more thermal properties of at least one of the support structure and the insulation material longitudinally from the bottom end to the top end, and cooling the mold axially upward from the bottom to the top.

C. An insulation enclosure that includes a support structure having a top end, a bottom end, and an interior, the bottom end defining an opening, and insulation material supported by the support structure and extending at least from the bottom end to the top end, wherein one or more thermal properties of at least one of the support structure and the insulation material varies about a circumference of the support structure.

D. A method that includes introducing a drill bit into a wellbore, the drill bit being formed within a mold heated in a furnace and subsequently cooled, wherein cooling the drill bit comprises removing the mold from the furnace, the mold having a top and a bottom, and placing the mold on a thermal heat sink with the bottom adjacent the thermal heat sink, lowering an insulation enclosure around the mold, the insulation enclosure including a support structure having a top end, a bottom end, and an interior for receiving the mold via an opening defined in the bottom end, the insulation enclosure further including insulation material supported by the support structure and extending at least from the bottom end to the top end, varying one or more thermal properties of at least one of the support structure and the insulation material longitudinally from the bottom end to the top end, and cooling the mold axially upward from the bottom to the top, and drilling a portion of the wellbore with the drill bit.

Each of embodiments A, B, C, and D may have one or more of the following additional elements in any combination: Element 1: wherein the support structure includes at least one of an outer frame and an inner frame. Element 2: wherein the support structure comprises the outer and inner frames and the insulation material is positioned within a cavity defined between the outer and inner frames. Element 3: wherein the insulation enclosure further comprises an insulative coating positioned on at least one of the inner frame and the outer frame. Element 4: wherein the support structure is made of a material selected from the group consisting of a metal, a metal mesh, ceramic, a composite material, and any combination thereof. Element 5: wherein the insulation material is a material selected from the group consisting of ceramics, ceramic fibers, ceramic fabrics, ceramic wools, ceramic beads, ceramic blocks, moldable ceramics, woven ceramics, cast ceramics, fire bricks, carbon fibers, graphite blocks, shaped graphite blocks, polymer beads, polymer fibers, polymer fabrics, nanocomposites, fluids in a jacket, metal fabrics, metal foams, metal wools, metal castings, any composite thereof, and any combination thereof. Element 6: further comprising a reflective coating positioned on an inner surface of the support structure. Element 7: wherein the one or more thermal properties are selected from the group consisting of thermal resistance, thermal conductivity, specific heat capacity, density, thermal diffusivity, temperature, surface characteristics, emissivity, absorptivity, and any combination thereof. Element 8: wherein the one or more thermal properties is thermal resistance and the thermal resistance of at least one of the support structure and the insulation material increases longitudinally from the bottom end to the top end. Element 9: wherein the one or more thermal properties is thermal conductivity and the thermal conductivity of at least one of the support structure and the insulation material decreases longitudinally from the bottom end to the top end. Element 10: further comprising one or more heating elements in thermal communication with the mold, wherein the one or more thermal properties is temperature and the one or more heating elements increases the temperature of at least one of the support structure and the insulation material longitudinally from the bottom end to the top end. Element 11: wherein the one or more heating elements is selected from the group consisting of a heating element, a heat exchanger, a radiant heater, an electric heater, an infrared heater, an induction heater, a heating band, heated coils, a heated fluid, an exothermic chemical reaction, and any combination thereof. Element 12: wherein the one or more heating elements is embedded within the insulation material. Element 13: wherein the one or more heating elements comprises a plurality of independently controlled heating coils. Element 14: wherein the one or more heating elements comprises a heating coil wrapped multiple revolutions about or within the support structure, and wherein a density of the revolutions of the heating coil is greater at the top end than the bottom end. Element 15: wherein the one or more thermal properties of at least one of the support structure and the insulation material are further varied about a circumference of the support structure. Element 16: wherein the one or more thermal properties include thermal resistance and thermal conductivity of at least one of the support structure and the insulation material.

Element 17: wherein the one or more thermal properties are selected from the group consisting of thermal resistance, thermal conductivity, specific heat capacity, density, thermal diffusivity, temperature, surface characteristics, emissivity, absorptivity, and any combination thereof. Element 18: wherein the one or more thermal properties is thermal resistance, the method further comprising increasing the thermal resistance of at least one of the support structure and the insulation material longitudinally from the bottom end to the top end. Element 19: wherein the one or more thermal properties is thermal conductivity, the method further comprising decreasing the thermal conductivity of at least one of the support structure and the insulation material longitudinally from the bottom end to the top end. Element 20: wherein the one or more thermal properties is temperature, the method further comprising increasing the temperature of at least one of the support structure and the insulation material longitudinally from the bottom end to the top end with one or more heating elements in thermal communication with the mold. Element 21: wherein the one or more heating elements comprises a plurality of heating coils, the method further comprising independently controlling each heating coil to increase the temperature of at least one of the support structure and the insulation material longitudinally from the bottom end to the top end. Element 22: further comprising varying the one or more thermal properties of at least one of the support structure and the insulation material about a circumference of the support structure, the one or more thermal properties being at least one of thermal resistance and thermal conductivity of at least one of the support structure and the insulation material. Element 23: further comprising drawing thermal energy from the bottom of the mold with the thermal heat sink.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. An insulation enclosure, comprising:

a support structure having a longitudinal axis, a top end, a bottom end, and an interior, the bottom end defining an opening for receiving a mold; and insulation material supported by the support structure and extending at least from the bottom end to the top end, wherein the enclosure defines first, second, and third longitudinal zones, the second longitudinal zone being located between the first and third longitudinal zones, and wherein a value of a thermal property of at least one of the support structure or the insulation material increases from the first longitudinal zone to the second longitudinal zone and from the second longitudinal zone to the third longitudinal zone.

2. The insulation enclosure of claim 1, wherein the support structure includes at least one of an outer frame disposed around the insulation material or an inner frame disposed within the insulation material.

3. The insulation enclosure of claim 2, wherein the support structure comprises the outer and inner frames and the insulation material is positioned within a cavity defined between the outer and inner frames.

4. The insulation enclosure of claim 3, wherein the insulation enclosure further comprises an insulative coating positioned on at least one of the inner frame or the outer frame.

5. The insulation enclosure of claim 1, wherein the support structure is made of a material selected from the group consisting of a metal, a metal mesh, ceramic, a composite material, and any combination thereof.

6. The insulation enclosure of claim 1, wherein the insulation material is a material selected from the group consisting of ceramics, ceramic fibers, ceramic fabrics, ceramic wools, ceramic beads, ceramic blocks, moldable ceramics, woven ceramics, cast ceramics, fire bricks, carbon fibers, graphite blocks, shaped graphite blocks, polymer beads, polymer fibers, polymer fabrics, nanocomposites, fluids in a jacket, metal fabrics, metal foams, metal wools, metal castings, any composite thereof, and any combination thereof.

7. The insulation enclosure of claim 1, further comprising a reflective coating positioned on an inner surface of the support structure.

8. The insulation enclosure of claim 1, wherein the thermal property is selected from the group consisting of thermal resistance, thermal conductivity, specific heat capacity, density, thermal diffusivity, temperature, surface characteristics, emissivity, and absorptivity.

9. The insulation enclosure of claim 1, wherein the property is thermal resistance and the thermal resistance of at least one of the support structure or the insulation material increases longitudinally from the bottom end to the top end.

10. The insulation enclosure of claim 1, wherein the thermal property is thermal conductivity and the thermal conductivity of at least one of the support structure or the insulation material decreases longitudinally from the bottom end to the top end.

11. The insulation enclosure of claim 1, further comprising one or more heating elements in thermal communication with the mold, wherein the thermal property is temperature and the one or more heating elements increases the temperature of at least one of the support structure or the insulation material longitudinally from the bottom end to the top end.

12. The insulation enclosure of claim 11, wherein the one or more heating elements is selected from the group consisting of a heating element, a heat exchanger, a radiant heater, an electric heater, an infrared heater, an induction heater, a heating band, heated coils, a heated fluid, an exothermic chemical reaction, and any combination thereof.

13. The insulation enclosure of claim 11, wherein the one or more heating elements is embedded within the insulation material.

14. The insulation enclosure of claim 13, wherein the one or more heating elements comprises a plurality of independently controlled heating coils.

15. The insulation enclosure of claim 13, wherein the one or more heating elements comprises a heating coil wrapped multiple revolutions about or within the support structure, and wherein a density of the revolutions of the heating coil is greater at the top end than the bottom end.

16. The insulation enclosure of claim 1, wherein the thermal property of at least one of the support structure or the insulation material varies about a circumference of the support structure.

17. The insulation enclosure of claim 16, wherein the property includes thermal resistance or thermal conductivity of at least one of the support structure and the insulation material.

* * * * *